US007030545B2

(12) United States Patent
Inoue et al.

(10) Patent No.: US 7,030,545 B2
(45) Date of Patent: Apr. 18, 2006

(54) FIELD EMISSION CATHODE WITH EMITTERS FORMED OF ACICULAR PROTRUSIONS WITH SECONDARY EMITTING PROTRUSIONS FORMED THEREON

(75) Inventors: Kazunori Inoue, Kawasaki (JP); Keiichi Betsui, Kawasaki (JP); Tadashi Nakatani, Kawasaki (JP); Osamu Toyoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/427,554

(22) Filed: Apr. 30, 2003

(65) Prior Publication Data

US 2003/0184203 A1 Oct. 2, 2003

Related U.S. Application Data

(63) Continuation of application No. PCT/JP00/07795, filed on Nov. 6, 2000.

(51) Int. Cl.
*H01J 1/02* (2006.01)
*H01J 1/62* (2006.01)

(52) U.S. Cl. ..... 313/309; 313/495; 313/336; 313/497

(58) Field of Classification Search ..... 313/309, 313/310, 293, 495, 336
See application file for complete search history.

(56) References Cited

U.S. PATENT DOCUMENTS

| | | | | |
|---|---|---|---|---|
| 5,864,147 | A * | 1/1999 | Konuma | 257/10 |
| 5,903,092 | A * | 5/1999 | Akama | 313/311 |
| 5,920,148 | A * | 7/1999 | Potter | 313/309 |
| 6,097,138 | A * | 8/2000 | Nakamoto | 313/309 |
| 6,504,292 | B1 * | 1/2003 | Choi et al. | 313/310 |
| 6,653,366 | B1 * | 11/2003 | Imai et al. | 523/160 |

FOREIGN PATENT DOCUMENTS

| | | |
|---|---|---|
| JP | 3-147226 | 6/1991 |
| JP | 6-196086 | 7/1994 |
| JP | 7-094078 | 4/1995 |
| JP | 7-335116 | 12/1995 |
| JP | 2000-208027 | 7/2000 |
| JP | 2000-268711 | 9/2000 |

* cited by examiner

*Primary Examiner*—Mariceli Santiago
*Assistant Examiner*—Anthony Perry
(74) *Attorney, Agent, or Firm*—Greer, Burns & Crain, Ltd

(57) ABSTRACT

A field-emission cathode having an emitter provided with a substrate, an emitter electrode layer, an insulating layer, a gate electrode layer, the layers being formed on the substrate in this order, needlelike projections for electron emission provided on the emitter electrode layer in a gate opening from which the insulating layer and the gate electrode layer are removed and each grown from one point in a given direction, and different projections for electron emission formed on all or part of the projections. The projections of the emitter are made of metallic particles, and thereby the manufacturing cost is lowered.

4 Claims, 11 Drawing Sheets

10 μm

FIELD EMISSION CATHODE WITH EMITTERS FORMED OF ACICULAR PROTRUSIONS WITH SECONDARY EMITTING PROTRUSIONS FORMED THEREON

This is a continuation of International PCT Application No. PCT/JP00/07795 filed Nov. 6, 2000.

TECHNICAL FIELD

The present invention relates to a field emission cathode and a process for producing the same, and in particular, it relates to a field emission cathode, which is one of micro cold cathodes applied to a micro vacuum tube, a microwave element, an ultrahigh speed operational element, a display element under a radiation environment (such as cosmic space and an atomic reactor) and a high temperature environment, and the like, and a process for producing the same.

BACKGROUND ART

An element using a field emission cathode has larger electron mobility and more resistant to high speed and high temperature operation and radiation damage than a semiconductor element. Accordingly, it is being utilized in these days as a display element demanded to have high luminance and low electric power consumption.

FIG. 10 shows a perspective view of a structure of a part of a field emission cathode having been conventionally used.

The field emission cathode is constituted from an emitter tip 101 having an apex, an emitter electrode 102 for applying a negative voltage to the emitter tip, and a gate electrode 103 for withdrawing electron. Upon applying a voltage between the emitter tip 101 and the gate electrode 102 as shown in FIG. 10, a large electric field is applied to the apex of the emitter tip to cause electron release.

FIG. 11 shows a schematic structural view of a display device using the conventional field emission cathode.

A cathode plate 109 has a glass substrate 105 on which emitter electrodes 102 in a stripe form are formed and gate electrodes 103 are formed in a direction perpendicular to the emitter electrodes 102 with a dielectric layer 104 interposed between the emitter electrode 102 and the gate electrode 103. Micro cathode arrays (FEAs) each comprising plural field emission cathodes are formed at pixels 106, which are intersection points of the emitter electrodes 102 and the gate electrode 103.

Fluorescent materials 108 of three colors, red (R), green (G) and blue (B), are applied on a surface of an upper anode plate 107, and cause light emission when electrons emitted from the field emission cathodes strike the fluorescent layers 108.

In general, the field emission cathode is often produced by a production process developed by C. A. Spint, et al. FIG. 12 shows an explanatory diagram of steps of the production process of a field emission cathode (cathode plate) developed by C. A. Spint, et al.

In FIG. 12(*a*), an emitter power feeding film 117 is formed on a dielectric substrate 116 formed of glass or the like, and then patterned to form an emitter electrode 102 as in FIG. 12(*b*).

Thereafter, a dielectric film 118 and a gate power feeding film 119 are formed in this order by plasma CVD or the like as in FIG. 12(*c*).

The gate power feeding film 119 and the dielectric film 118 are separately etched by using a resist pattern having circular gate openings to form gate openings 120 in a cylindrical form having a diameter of about 1 μm as in FIG. 12(*d*).

Subsequently, a sacrifice layer material, such as aluminum, is obliquely deposited on the dielectric substrate 116 to prevent its deposition on the emitter power feeding film 117 in the gate openings 120 to form a sacrifice layer film 121 as in FIG. 12(*e*).

Furthermore, an emitter metal material 122, such as molybdenum, is perpendicularly deposited on the dielectric substrate 116 as in FIG. 12(*f*). At this time, the gate openings 120 are gradually plugged with the accumulated emitter metal material with the lapse of time, and when they are completely plugged, emitter tips 101 having a conical form are formed in the gate openings 120 as in FIG. 12(*f*).

The sacrifice layer 121 is then selectively dissolved with a phosphoric acid aqueous solution or the like to remove the emitter metal material 122 except the emitter tips 101 as in FIG. 12(*g*).

Finally, the gate power feeding film 119 is patterned to a desired shape to complete minute field emission cathodes as in FIG. 12(*h*) of the figure.

In this production process, however, so-called vacuum heating deposition is used for forming the emitter tips in the process step shown in FIG. 12(*f*), and in order to produce the emitter tips with high accuracy, it is necessary that the emitter metal material is deposited in a direction substantially perpendicular to the substrate by using an expensive deposition apparatus.

In other words, the production cost is difficult to reduce because of the formation step of the emitter tips.

Accordingly, an object of the invention is to realize simplification and cost reduction of the production process of a field emission cathode by forming protrusions capable of emitting electrons by using a material containing predetermined metal fine particles.

DISCLOSURE OF THE INVENTION

The invention provides a field emission cathode comprising a substrate having formed thereon an emitter electrode layer, a dielectric layer and a gate electrode layer in this order, and an emitter having a structure in which plural acicular protrusions for emitting electrons are developed to an arbitrary direction from points on the emitter electrode layer inside gate openings, in which openings the dielectric layer and the gate electrode layer are removed, and in which other protrusions for emitting electrons are formed on all or a part of the protrusions.

BRIEF DESCRIPTION OF THE DRAWINGS

FIG. 3(*e*) shows a liquid crystal dielectric material coated on a protrusion.

MODE FOR CARRYING OUT THE INVENTION

The present invention provides a field emission cathode comprising a substrate having formed thereon an emitter electrode layer, a dielectric layer and a gate electrode layer in this order, and an emitter having a structure in which plural acicular protrusions for emitting electrons are developed to an arbitrary direction from points on the emitter electrode layer inside gate openings, in which openings the dielectric layer and the gate electrode layer are removed, and in which other protrusions for emitting electrons are formed on all or a part of the protrusions.

The protrusions may be formed of metallic fine particles containing, for example, indium oxide and tin oxide (ITO: Indium Tin Oxide). Also, all or a part of the protrusions may be covered with a dielectric material.

Further, the present invention provides a field emission cathode comprising an emitter having a structure in which plural acicular protrusions for emitting electrons are developed from to an arbitrary direction points on an emitter electrode layer containing metal fine particles, the emitter electrode layer being formed on a substrate, and in which other protrusions for emitting electrons are formed on all or a part of the protrusions.

Moreover, the present invention provides a process for producing a field emission cathode comprising coating an organic solvent containing predetermined metal fine particles on a substrate, drying a coating layer on the substrate in an atmosphere of a higher nitrogen concentration than that in the air, and baking at a predetermined temperature, so as to form plural acicular protrusions for emitting electrons developed from points on a surface of the coated layer to an arbitrary direction.

The drying step may be carried out at a temperature of from 50 to 280° C. inclusive in an atmosphere of a nitrogen concentration of from 80 to 100% inclusive until a thin film is formed on a surface of the organic solvent coated on the substrate.

The baking step may be carried out at a temperature of 280° C. or more in an atmosphere of a nitrogen concentration of from 80 to 100% inclusive under a condition of a wind speed of a nitrogen gas flowing in the vicinity of the surface of the substrate of 10 m/sec or less.

As the metal fine particles, those containing indium oxide and tin oxide may be utilized.

As the organic solvent, those containing one of ethyl alcohol, 2-methoxyethanol and 4-hydroxy-4-methyl-2-pentanone may be used.

The invention will be described in detail based on an embodiment shown in the figures. The invention is not construed as being limited thereto.

Figure 1:
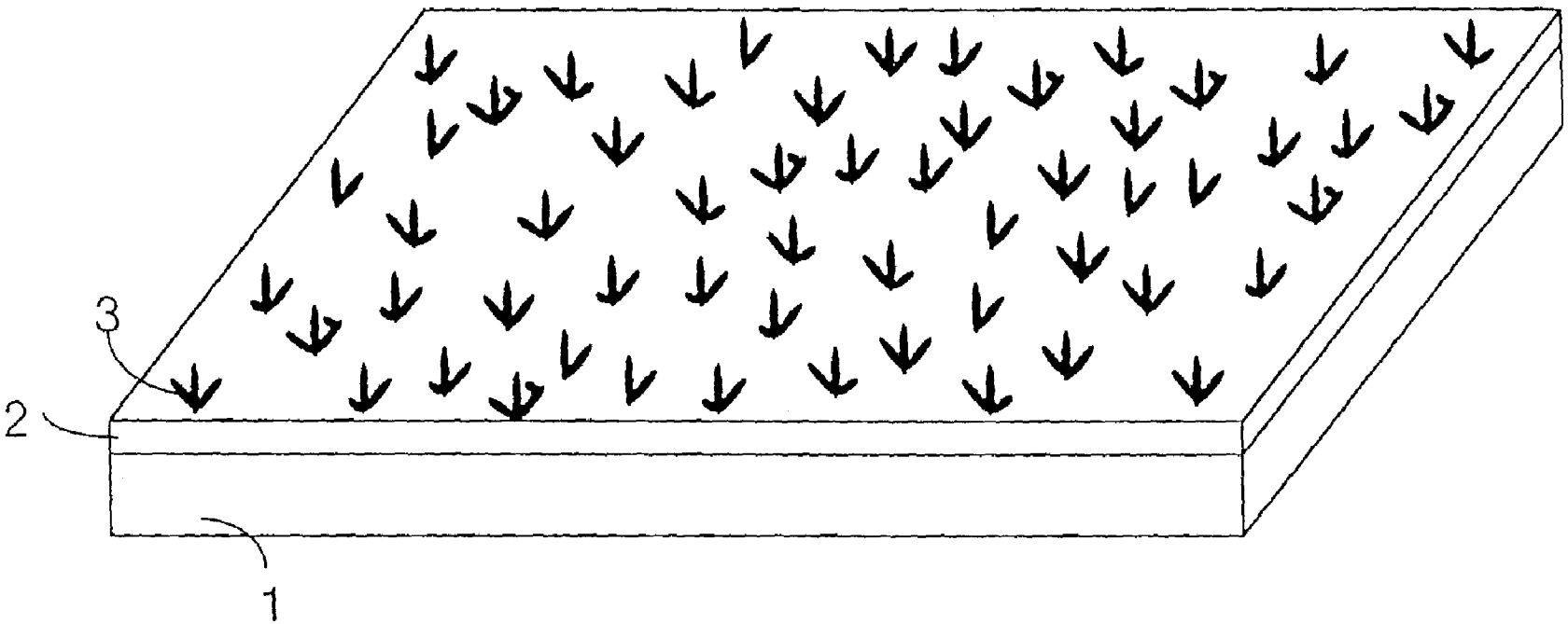
FIG. 1 is a schematic perspective view of a field emission cathode according to the invention.

FIG. 1 shows a schematic perspective view of a field emission cathode according to the invention.

What is shown herein is a structure in which an emitter comprising protrusions for emitting electrons is formed on a substrate before formation of a gate electrode.

The reference numeral 1 denotes a substrate formed of glass or the like, the reference numeral 2 denotes an emitter electrode layer, and the reference numeral 3 denotes protrusions for emitting electrons.

The emitter electrode layer 2 is such a layer that is formed by drying and baking an organic solvent containing metal fine particles coated on the substrate 1, and the acicular protrusions 3 are formed at arbitrary positions on a surface of the layer.

The acicular protrusions 3 have an acicular structure protruding in an arbitrary direction from an arbitrary point on the emitter electrode layer 2 on the surface of the substrate. There may be such a structure that another protrusion is branched from a midway point of one of the protrusions.

Figure 4:
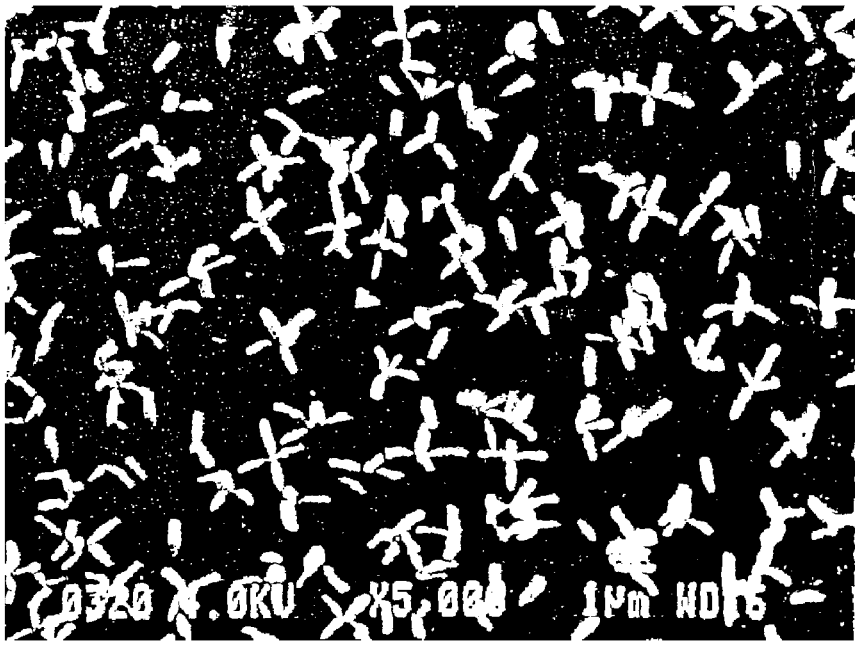
FIG. 4 is a perspective view of an example of a state where protrusions are formed according to the invention.
Figure 5:
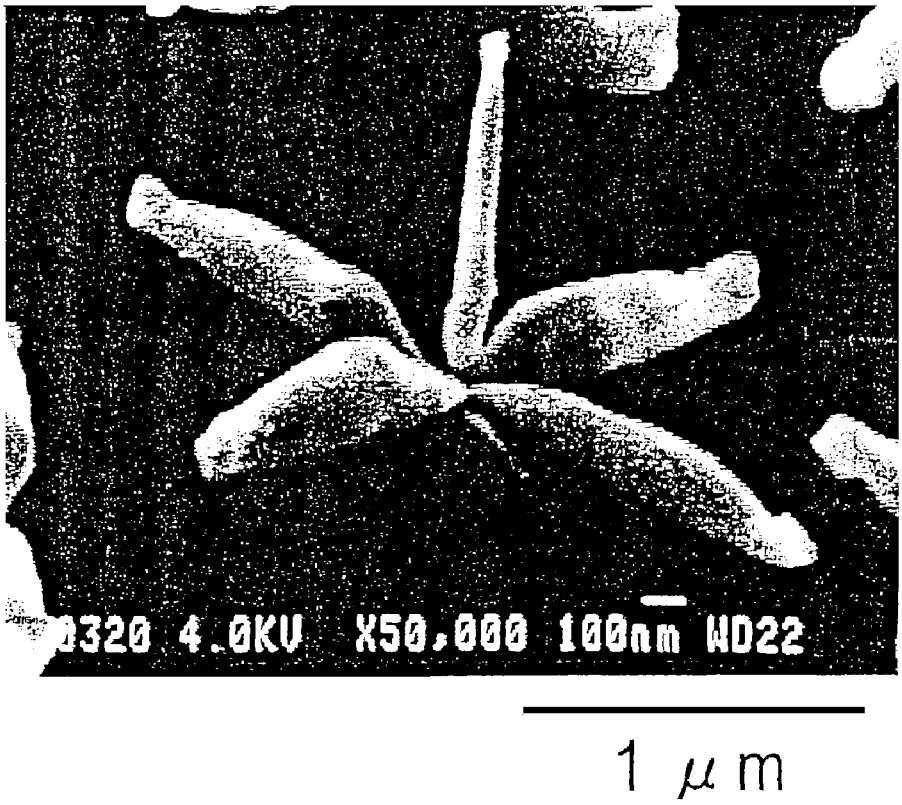
FIG. 5 is an enlarged perspective view of the state where the protrusions are formed according to the invention.

FIGS. 4 and 5 show perspective views of an example of a state where the protrusions are formed.

FIG. 4 is a perspective view showing protrusions formed on the surface of the substrate, and FIG. 5 is an enlarged perspective view of one of the protrusions shown in FIG. 4.

The protrusions in this example are formed by coating an organic solvent mixed with ITO fine particles, i.e., a so-called an ITO ink, on a glass substrate, and then applying a predetermined drying and baking step described later.

In FIGS. 4 and 5, the height of one protrusion is about from 0.1 to 3 μm, and the diameter of a branch of the protrusion is about 100 nm. Several tens of protrusions are formed per a area of 10 $\mu m^2$.

An example of a forming step of the protrusions functioning as an emitter of a field emission cathode of the invention will be described below.

In the following example, a glass substrate is used as the substrate 1 for forming the cathode, and an ITO ink (DX418, produced by Sumitomo Metal Mining Co., Ltd., viscosity at 25° C.: 135 cps) is used as a material for forming the emitter electrode layer 2 and the protrusions 3, but the substrate and the material are not limited thereto.

The ITO ink contains, as constitutional components, organic indium (In) and organic tin (Sn) as metal fine particles, cellulose as a binder, and terpineol and isophorone as an organic solvent.

The organic In and the organic Sn are fine particles having a tabular ellipsoidal shape with a length of about 200 to 300 Å.

As the organic solvents, those containing one of ethyl alcohol, 2-methoxyethanol and 4-hydroxy-4-methyl-2-pentanone may be used in addition to the foregoing organic solvent.

Figure 2:
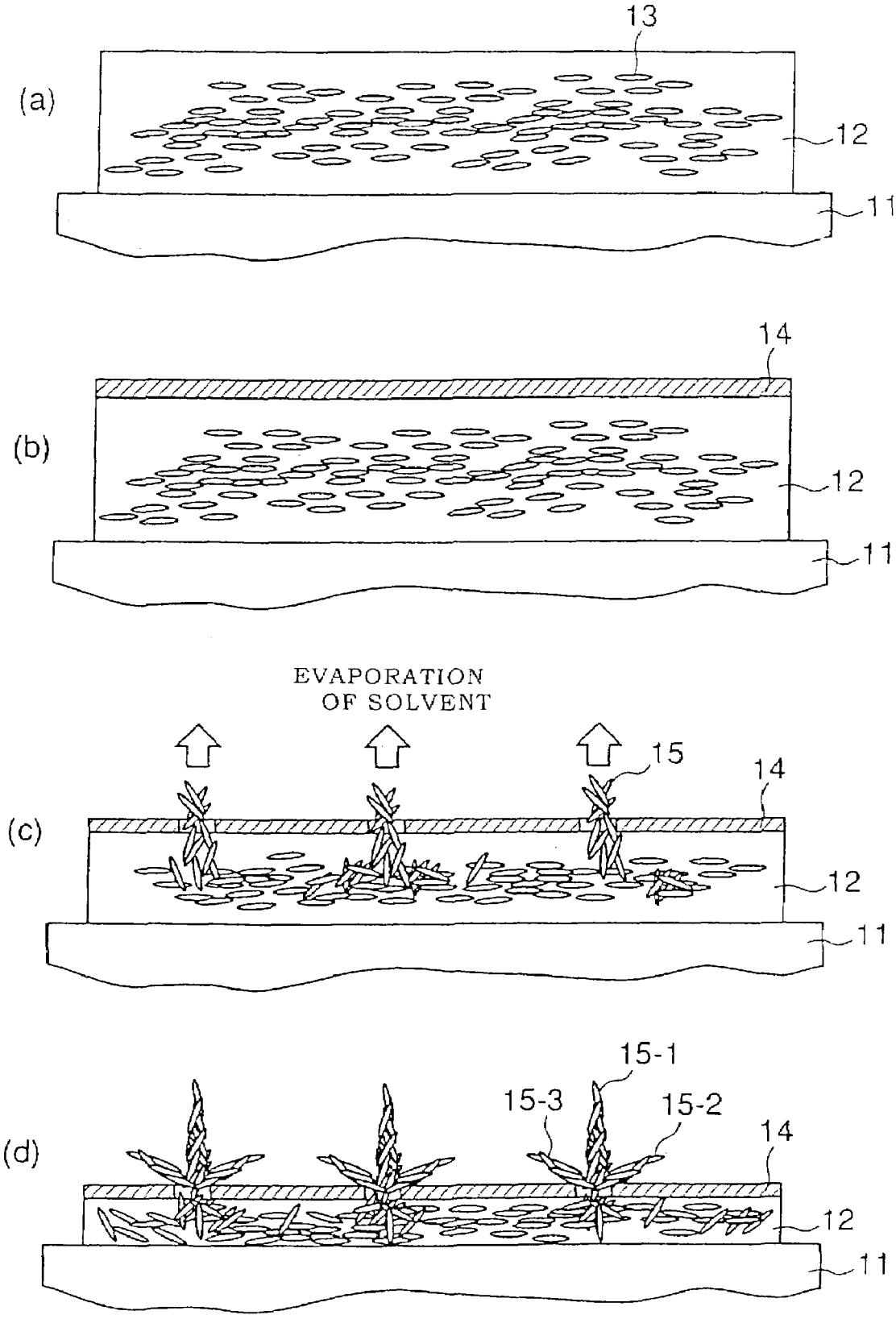
FIGS. 2(*a–d*) are explanatory diagrams of process steps for forming protrusions according to the invention.

FIG. 2 shows an explanatory diagram of an example of a forming step of the protrusions according to the invention.

As shown in FIG. 2(*a*), an ITO ink 12, which is an organic solvent containing fine metal particles 13 (the organic In and the organic Sn), is coated on a glass substrate 11 by a spin coating method or a printing method to a thickness of about 5,000 Å.

As in FIG. 2(*b*), the ITO ink 12 is then dried to such an extent that a thin film is formed on the surface of the ITO ink 12.

The drying is carried out at a temperature of from 50 to 280° C. inclusive in an atmosphere of a higher nitrogen concentration (80 to 100% inclusive) than that in the air.

The optimum value for the drying time varies depending on the temperature conditions, and for example, the drying may be carried out for about 30 minutes at 120° C.

The formation of the thin film 14 can be confirmed by the fact that it is not etched when immersed in a mixed acid as an etchant for ITO.

A preferred thickness of the thin film 14 formed cannot be determined unconditionally, and for example, the drying may be carried out to obtain a thickness of about 100 nm.

As shown in FIG. 2(*c*), the entire structure is baked to such an extent that protrusions are developed to break the thin film 14 to form the emitter electrode layer 12.

The baking is carried out at a temperature of about from 280 to 600° C. inclusive in an atmosphere of a nitrogen concentration of 80 to 100% inclusive.

In order that protrusions 15 are sufficiently developed upward with respect to the substrate, it is preferred that the wind speed of a nitrogen gas in the vicinity of the surface of the substrate is 10 m/sec or less. In the case of a wind speed exceeding the value, the protrusions are blown off to result in a failure to form a practical emitter.

For example, at 430° C., a nitrogen concentration of 99% and a wind speed of a nitrogen gas in the vicinity of the surface of the substrate of 10 m/sec, development of the practical protrusions 15 and formation of the emitter electrode layer 12 are obtained by baking for about 10 minutes.

During the baking, minute holes are formed at arbitrary positions of the thin film 14 with the lapse of time, whereby the organic solvent inside is evaporated through the holes, and the metal fine particles are developed as the protrusions 15 in an arbitrary direction while breaking the thin film 14.

The shape and the number of the protrusions thus formed vary depending on the mixing amount of the fine particles, and more protrusions are liable to be formed when the mixing amount of the fine particles is larger, as shown in FIG. 2(*d*) where protrusions 15-2 and 15-3 are branched from protrusion 15-1 protruded from one point.

Electrons are emitted from tip ends of the protrusions 15, and when a larger number of branched protrusions are formed from one point to make a larger number of electron emitting points, stable electron emission is realized.

After the baking is carried out, both the protrusions (15-1, 15-2 and 15-3) protruding beyond the thin film and a layer 12 to be the emitter electrode layer are formed as shown in FIG. 2(*d*). Herein, the height of the protrusions is 3 μm at most, and the thickness of the emitter electrode layer 2 is about 1,000 Å.

Figure 3:
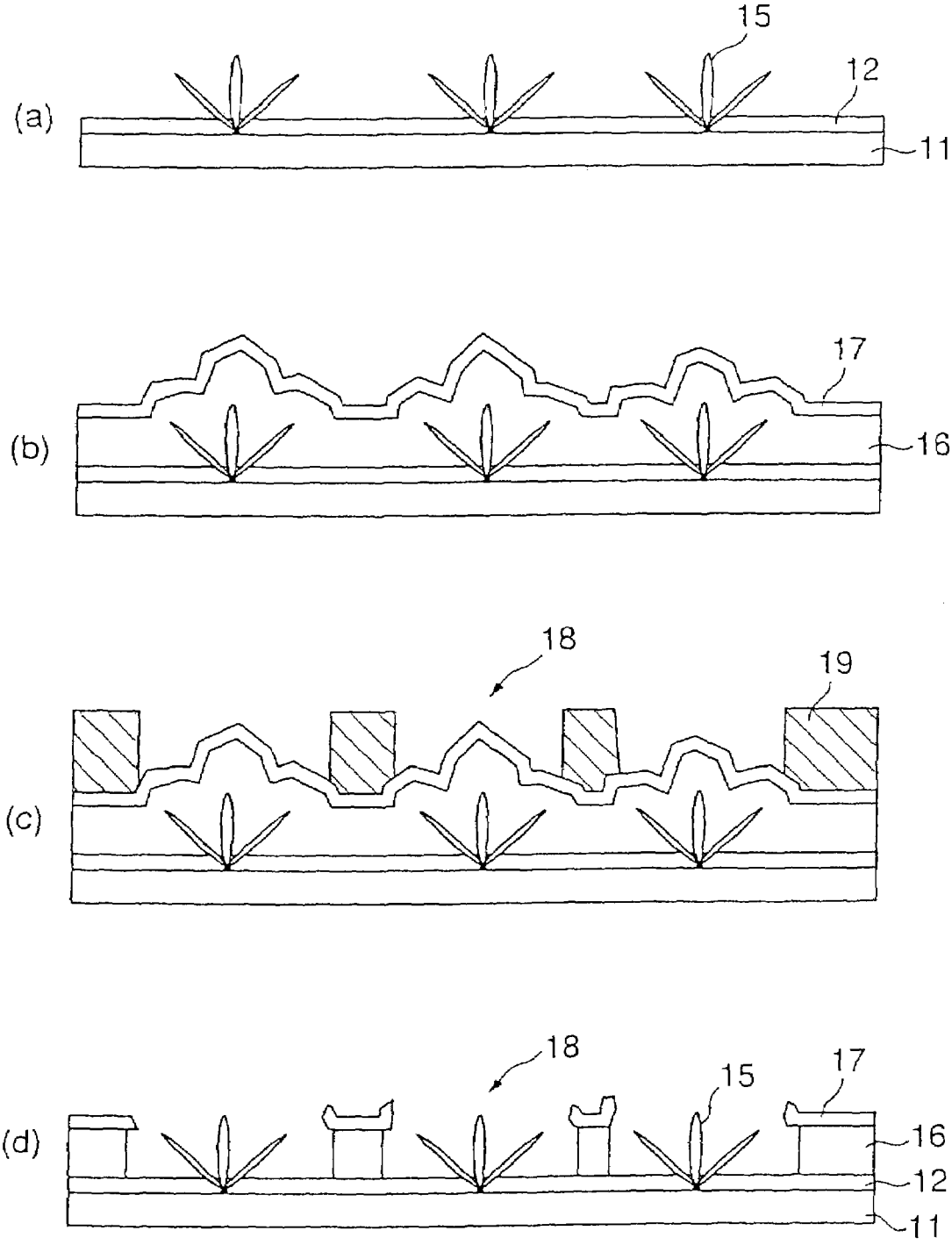
FIGS. 3(*a–d*) are explanatory diagrams of process steps for forming a field emission cathode according to the invention.
Figure 10:
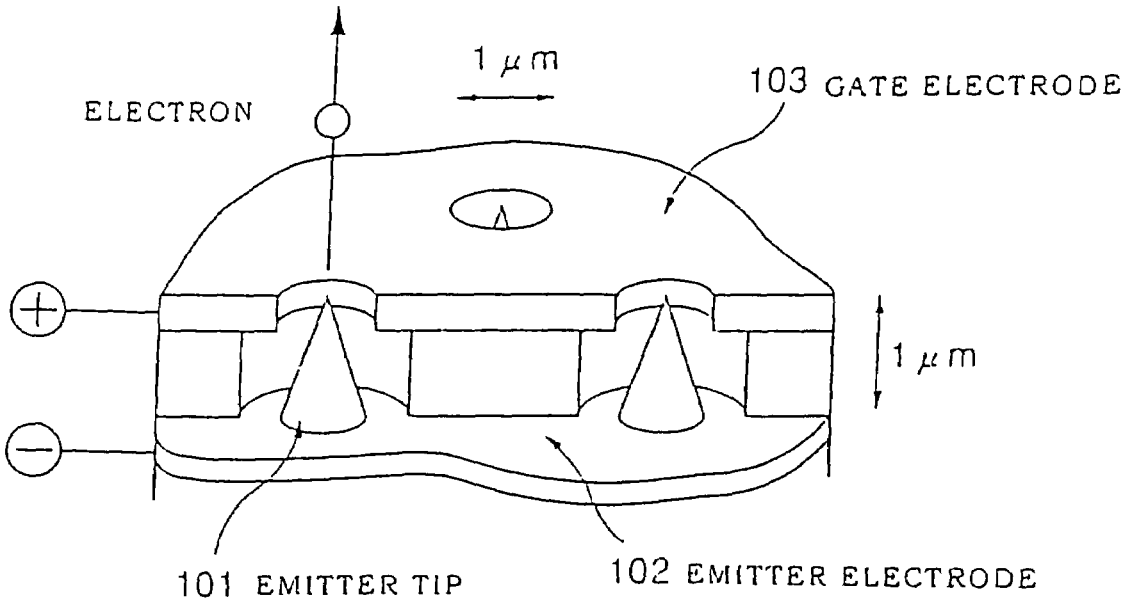
FIG. 10 Prior Art
FIG. 10 is a perspective view showing a structure of a conventional field emission cathode.
Figure 3E:
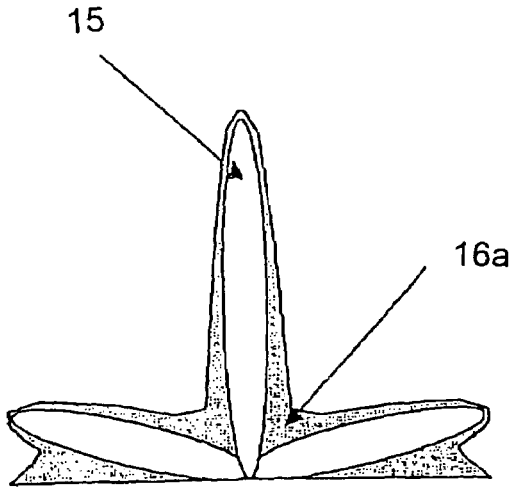

FIG. 3 shows an explanatory diagram of the formation steps of the field emission cathode of the invention after the formation of the protrusions shown in FIG. 2.

FIG. 3(*a*) shows a structure corresponding to that of FIG. 2(*d*), in which the emitter electrode layer 12 and the protrusions 15 are formed on the substrate 11.

While the protrusions 15 to function as an emitter are formed at arbitrary positions on the substrate 11 in the structure shown in FIG. 2(*d*), the protrusions 15 only at predetermined positions are allowed to remain by carrying out etching to form an emitter in regions to be pixels.

For example, a resist is coated on the structure shown in FIG. 3(*a*), and is exposed to light by using a predetermined mask pattern, and the protrusions 15 in regions irradiated with light are removed by etching and the like so that the protrusions 15 only in regions to be pixels are allowed to remain.

A dielectric film 16 is formed on the structure, and a gate electrode film 17 is deposited thereon, as shown in FIG. 3(*b*).

For example, the dielectric film 16 is formed to such an extent that it covers the entire protrusions 15 (film thickness: 2 μm) by using a plasma CVD process. The dielectric film 16 may be formed of, for example, $SiO_2$.

The plasma CVD process may be carried out under conditions of, for example, a substrate temperature of 300° C., gas species of $SiH_4$ and $N_2O$, a gas pressure of 670 mmTorr, and a film forming time of about 23 minutes.

The gate electrode film 17 may be formed by depositing, for example, a metal material, such as Cr, Mo, $MoSi_2$, to about 1,000 Å by using a sputtering process.

In order to form a pattern of gate openings 18 in regions where emitters are to be formed, a resist 19 is patterned as shown in FIG. 3(*c*).

For example, the resist 19 having a thickness of about 1 μm is coated on the structure shown in FIG. 3(*b*), and is exposed to light by using a predetermined mask pattern, and the resist 19 at parts that are not irradiated with light, i.e., the gate openings 18, is removed. The diameter of the gate opening 18 is, for example, about 10 μm.

In order to reveal the protrusions 15 inside the gate openings 18, the gate electrode 17 and the dielectric film 16 inside the gate openings 18 are then removed.

For example, the gate electrode 17 and the dielectric film 16 can be removed by wet etching (with a cerium nitrate solution for 3 minutes) or hydrofluoric acid etching (with a buffer hydrofluoric acid solution ($HF/NH_4F/H_2O$= 40/175/685) for 4 minutes 30 second).

Thus, the protrusions 15 functioning as an emitter are revealed inside the gate openings 18.

Furthermore, the remaining resist 19 is removed by ultrasonic cleaning with acetone to complete the field emission cathode of the invention as shown in FIG. 3(*d*).

In the case where electrons are emitted by using the field emission cathode thus produced, such a field emission cathode having stable electron emission characteristics is obtained that is equivalent or superior to one where conventional conical emitter tips are used, owing to the structure where one emitter is constituted of plural protrusions capable of emitting electrons.

Furthermore, in the step of forming protrusions corresponding to the conventional emitter tips, the protrusions are formed only by relatively simple process steps, i.e., coating, drying and baking, but not using a complicated and expensive step of vacuum heating deposition of an emitter material, whereby the production cost of the field emission cathode can be further suppressed.

In order that the stability of electron emission characteristics is further improved, it is possible as shown in FIG. 3(*e*) that a liquid dielectric material 16*a* is coated on the structure formed in FIG. 2(*d*) to cover the entire or part of the surface of the protrusions 15.

For example, after the protrusions are formed in FIG. 2(*d*), an $SiO_2$-containing film forming coating solution, which is generally referred to as SOG (spin on glass), is coated on the entire surface by spin coating or the like, followed by baking at 300° C.

The $SiO_2$-containing film forming coating solution is, for example, that containing methanol and methyl cellosolve as main components, and OCD Series of Tokyo Ohka Kogyo Co., Ltd. may be used.

In the case where the protrusions are covered with a dielectric material, adhesion between the protrusions and the substrate is improved to prevent such a phenomenon that the protrusions are released from the substrate when the process steps shown in FIG. 3 is carried out after the formation of the protrusions. Therefore, a larger number of protrusions can be left than when the protrusions are not covered with a dielectric material, whereby the reliability upon production is increased, and the stability of electron emission characteristics is improved.

An embodiment of a field emission cathode of a matrix structure having a gate electrode according to the invention will be now described.

Figure 6:
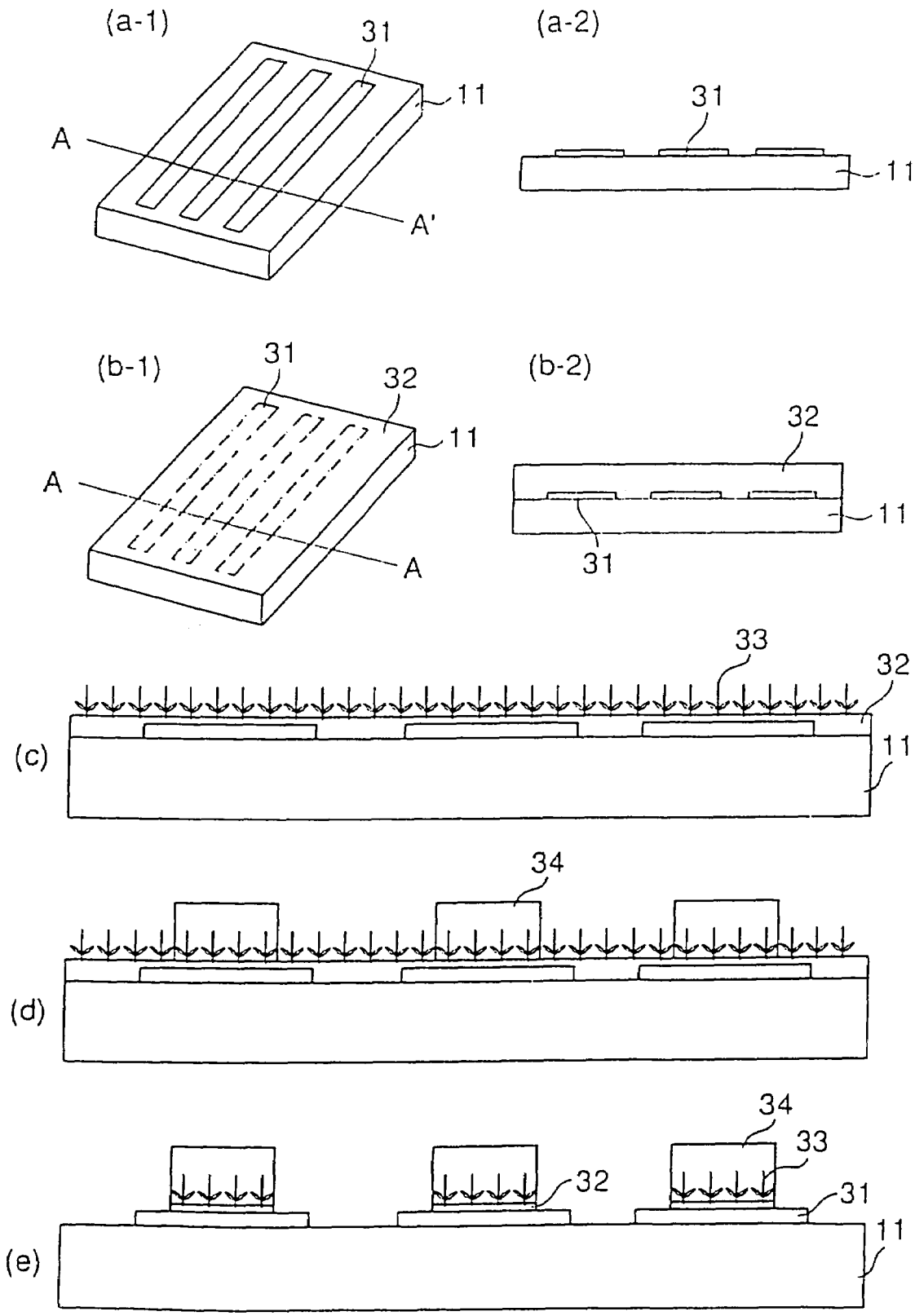
FIGS. 6($a_1$–$a_2$), 6($b_1$–$b_2$), and 6(*c–e*) are explanatory diagrams of an example of production steps of a field emission cathode of a matrix structure having a gate electrode according to the invention.
Figure 7:
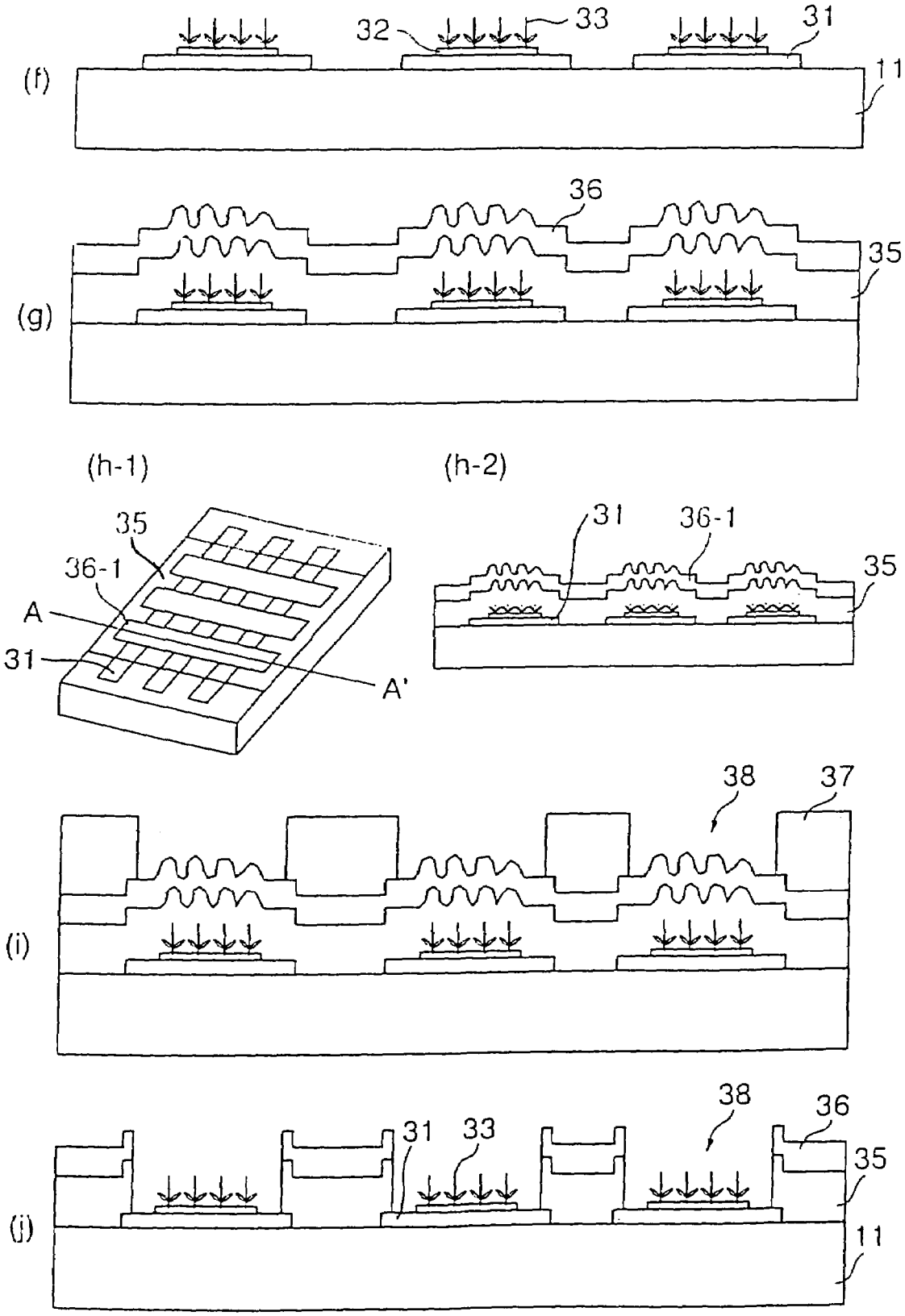
FIGS. 7(*f–g*), 7($h_1$–$h_2$), and 7(*i–j*) are explanatory diagrams of an example of other production steps of the field emission cathode of the matrix structure having the gate electrode according to the invention.

The production process steps of a field emission cathode of a matrix structure of the invention are shown in FIGS. 6(*a*) to 6(*e*) and FIGS. 7(*f*) to 7(*j*). Herein, while such an example is shown in the figures that emitter electrodes and gate electrodes perpendicularly intersect each other to form a field emission cathode of a matrix structure of 3×3, it is also possible to produce a filed emission cathode having a matrix structure of n×n pixels, where generally n≧3 by the following production process steps.

FIG. 6(*a*):

A power feeding electrode layer for emitters is previously formed on the glass substrate 11 to 1,000 Å by sputter vapor deposition of $MoSi_2$, and an emitter electrode pattern 31 having a stripe form is formed through patterning with a resist and dry or wet etching. In FIG. 6, (*a*-1) is a perspective view of the entire substrate after the formation of the emitter electrode pattern, and (*a*-2) is a cross sectional view on line A–A'.

FIG. 6(*b*):

An ITO ink 32 (DX418, viscosity at 25° C.: 135 cps) is coated on the entire substrate by spin coating (500 rpm for 5 seconds, and 3,000 rpm for 20 seconds) and dried at 120° C. for 20 minutes under a nitrogen concentration of 100%. In FIG. 6, (*b*-1) is a perspective view after the coating of the ITO ink 32, and (*b*-2) is a cross sectional view on line A–A'. Thus, a thin film is formed on a surface of the ITO ink in a similar manner to that shown in to FIG. 2(*b*).

FIG. 6(*c*):

The substrate is heated to 430° C. for 10 minutes under a nitrogen concentration of 100% to bake the ITO ink having the thin film formed thereon to form protrusions 33 on the entire substrate.

FIG. 6(*d*):

A resist 34 is formed on regions corresponding to gate openings on the emitter electrode pattern 31 through patterning.

FIG. 6(*e*):

The protrusions in regions other than the regions covered with the resist 34 are etched with a mixed acid, which is an etchant for ITO.

FIG. 7(*f*):

The resist 34 is removed by ultrasonic cleaning with acetone.

FIG. 7(*g*):

A dielectric film ($SiO_2$) 35 of about 1 μm is accumulated by CVD, and a gate electrode 36 of about 2,000 Å is accumulated by sputtering deposition of Cr, in this order.

FIG. 7(*h*):

After a gate electrode pattern is formed through patterning of a resist, Cr is etched with a cerium nitrate solution to form a gate electrode pattern 36-1 of a stripe form intersecting the emitter electrode pattern 31. In FIG. 7, (*h*-1) is a perspective view at the time of forming the gate electrode pattern, and (*h*-2) is a cross sectional view on line A–A'.

FIG. 7(*i*):

Openings 38 corresponding to pixel regions where the protrusions 33 are present are formed by patterning a resist 37.

FIG. 7(*j*):

After the gate electrode pattern inside the gate openings 38 is etched with a cerium nitrate solution, $SiO_2$ as the dielectric film 35 is removed by wet etching with a hydrofluoric acid aqueous solution to reveal the protrusions 33, and then the resist 37 is removed by ultrasonic etching of acetone or the like manner.

According to the process steps, such a field emission cathode having a gate electrode can be produced that has a matrix structure of 3×3 pixels, in which the widths of the emitter electrode and the gate electrode are each about 100 μm, the electrode intervals between the emitter electrodes and between the gate electrodes are each about 100 μm, the diameters of gate electrode openings at intersections of the emitter electrode and the gate electrode, are each about 10 μm.

Figure 8:
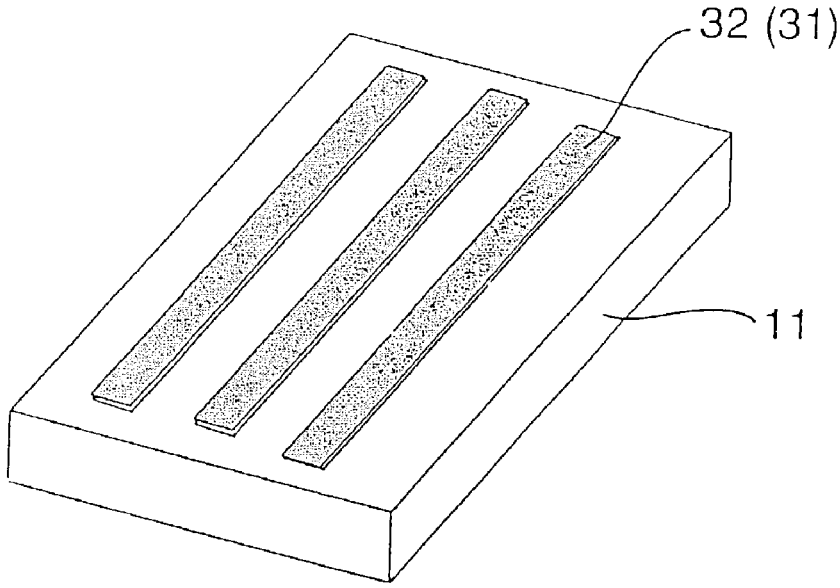
FIG. 8 is an explanatory diagram of another example of a coating step of an ITO ink according to the invention.

While the ITO ink is coated on the entire substrate as in FIG. 6(*b*), the ITO ink may be coated by printing to lie on the emitter power feeding electrodes 31 as shown in FIG. 8. As a result, although the coating process of the ITO ink becomes complicated, the ITO ink is not attached to other parts than the emitter electrodes to provide such advantages that the using amount of the ITO ink can be saved, and possibility of short circuit between adjacent emitter electrodes due to etching failure is decreased.

Figure 9:
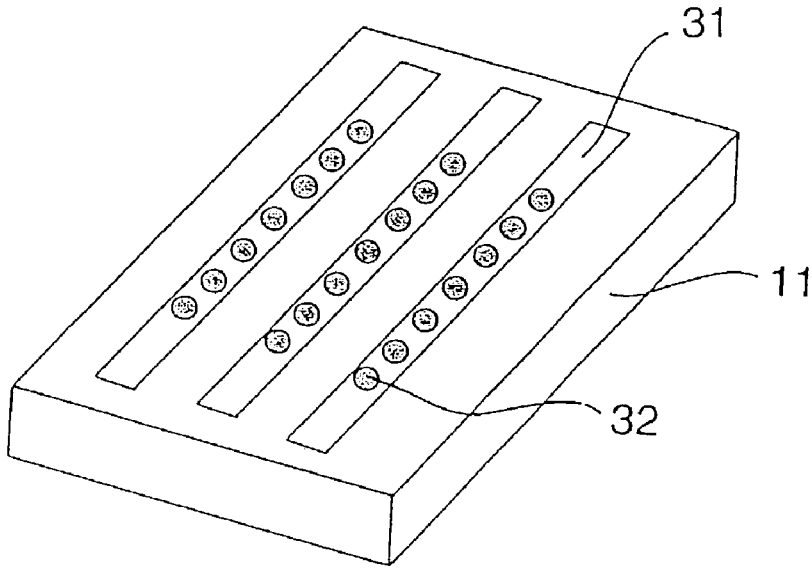
FIG. 9 is an explanatory diagram of another example of the coating step of the ITO ink according to the invention.
Figure 11:
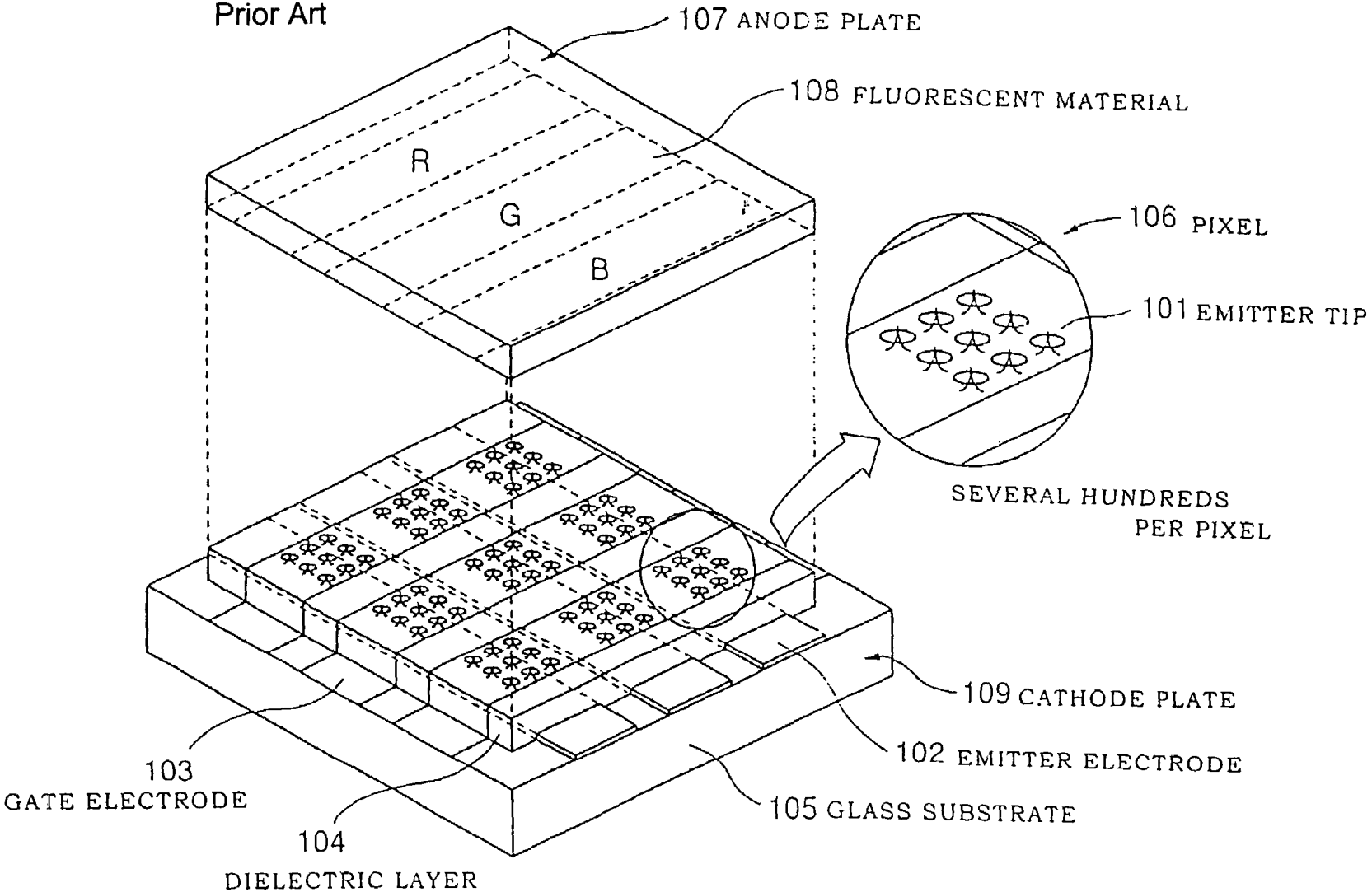
FIG. 11 Prior Art
FIG. 11 is a schematic structural view of a display device using the conventional field emission cathode.
Figure 12:
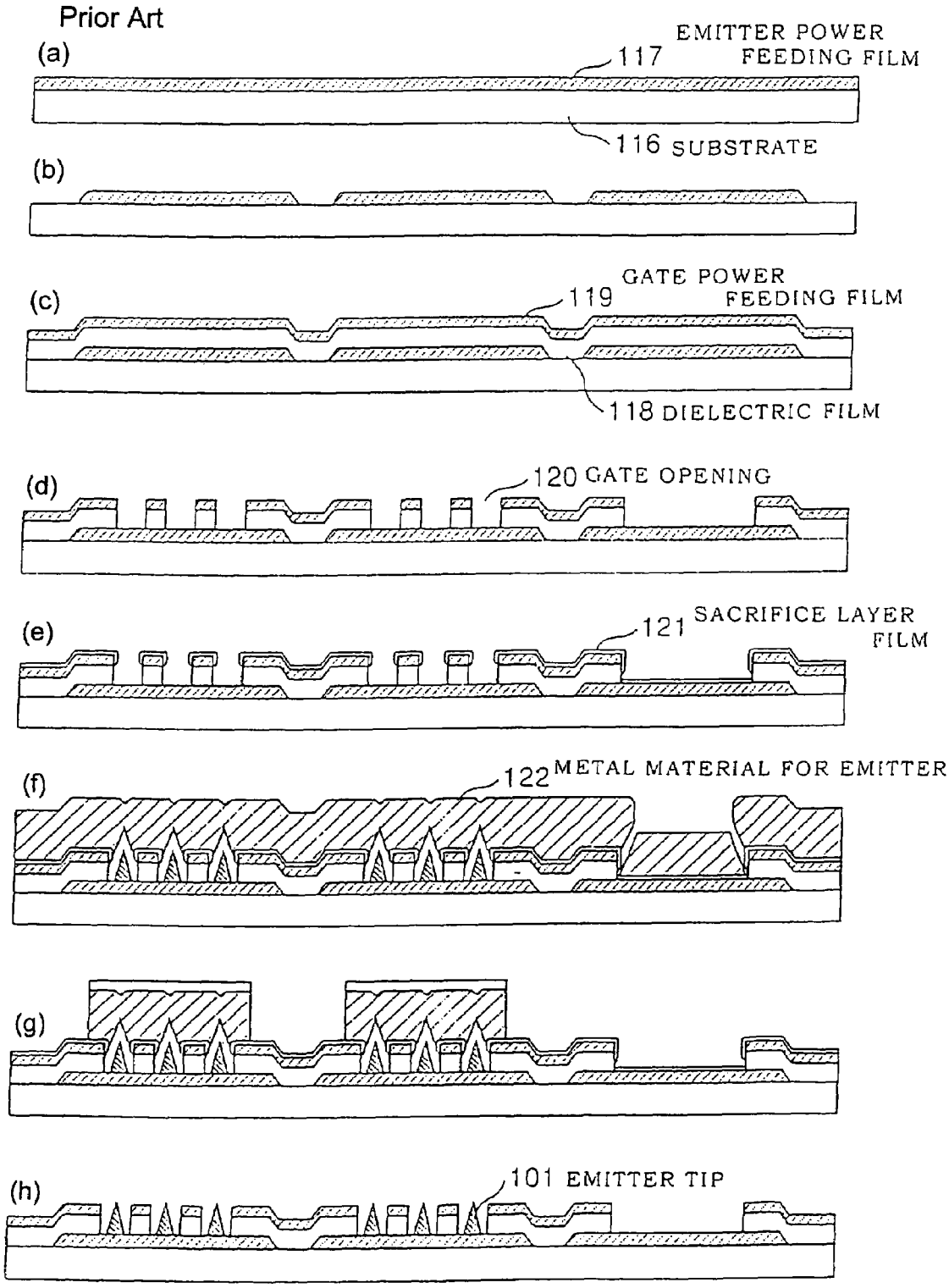
FIG. 12 Prior Art
FIGS. 12(*a–h*) are explanatory diagrams of steps of a conventional production process of a field emission cathode.

Furthermore, instead of the whole area coating of the ITO ink as in FIG. 6(*b*), it is also possible as shown in FIG. 9 that the ITO ink is coated by printing on circular regions corresponding to the gate openings 38 corresponding to pixels on the emitter power feeding electrodes 31. As a result, the regions where the protrusions are formed are determined to provide such an advantage that the subsequent production steps are simplified.

According to the invention, an emitter of a field emission cathode is constituted of acicular protrusions, which can be easily produced, whereby the production cost of the field emission cathode can be suppressed, and such a filed emission cathode can be provided that has stable electron emission characteristics.

The invention claimed is:

1. A field emission cathode comprising:

a substrate having formed thereon an emitter electrode layer, a dielectric layer and a gate electrode layer in this order; and an emitter having a structure in which plural gate openings are formed on the emitter electrode layer, the dielectric layer and the gate electrode layer being removed in the gate openings, and in which plural primary acicular protrusions for emitting electrons are developed from points each having an area smaller than that of each gate opening, the primary protrusions having tips that are separated from each other without overlapping, all of or part of the primary protrusions having secondary protrusions for emitting electrons formed thereon, wherein said primary protrusions extend from said emitter electrode layer in a first direction, and said secondary protrusions extend from said primary protrusions in directions different from said first direction.

2. A field emission cathode of claim 1, wherein the primary and secondary protrusions are formed of metal fine particles containing ITO.

3. A field emission cathode of claim 2, wherein the primary and secondary protrusions are covered with a dielectric material.

4. A field emission cathode comprising an emitter having a structure in which an emitter electrode layer containing metal fine particles is formed on a substrate, and in which plural primary acicular protrusions for emitting electrons are developed to arbitrary directions from points on the emitter electrode layer, the primary protrusions having tips that are separated from each other without overlapping, all of or part of the primary protrusions having secondary protrusions for emitting electrons formed thereon, wherein said primary protrusions extend from said emitter electrode layer in a first direction, and said secondary protrusions extend from said primary protrusions in directions different from said first direction.

* * * * *